US005983397A

United States Patent [19]

Seminara

[11] Patent Number: 5,983,397

[45] Date of Patent: Nov. 16, 1999

[54] BATTING GLOVE

[76] Inventor: Robert S. Seminara, 69 Bay Ridge Pkwy., Brooklyn, N.Y. 11209

[21] Appl. No.: 09/231,621

[22] Filed: Jan. 14, 1999

[51] Int. Cl.[6] ..... A41D 19/00

[52] U.S. Cl. ..... 2/161.1; 2/16; 2/161.6; 2/910; 273/108.3; 473/205; D29/117

[58] Field of Search ..... 2/16, 20, 21, 159, 2/161.1, 161.2, 161.3, 161.4, 161.5, 161.6, 163, 910; 273/108.3, 317.6; 294/25; 473/205; D29/117

[56] References Cited

U.S. PATENT DOCUMENTS

| | | | |
|---|---|---|---|
| 2,302,875 | 11/1942 | Lykins | 2/161.1 |
| 3,031,680 | 5/1962 | Compiano . | |
| 3,065,472 | 11/1962 | Linnell | 2/161.1 |
| 3,496,573 | 2/1970 | Kuchar . | |
| 3,863,271 | 2/1975 | Moroney . | |
| 4,000,903 | 1/1977 | Swanson | 473/205 |
| 4,329,741 | 5/1982 | Bach | 2/161.2 |
| 4,461,043 | 7/1984 | Lomedico | 2/21 |
| 4,700,405 | 10/1987 | Sternberg | 2/19 |
| 4,738,447 | 4/1988 | Brown | 473/450 |
| 4,843,651 | 7/1989 | Gramza | 2/161.1 |
| 5,218,719 | 6/1993 | Johnson | 2/19 |
| 5,471,682 | 12/1995 | Robins | 2/161 |
| 5,588,651 | 12/1996 | Frost | 473/206 |
| 5,634,214 | 6/1997 | St. Ville | 2/161.2 |
| 5,890,228 | 4/1999 | Wagner | 2/160 |

*Primary Examiner*—Diana Oleksa
*Assistant Examiner*—Kate M. Moran
*Attorney, Agent, or Firm*—John D. Titus

[57] ABSTRACT

A batting glove is provided incorporating a leather palm portion, a leather wrist portion including a hook and loop fastener, a leather finger portion including separate finger members having spaces therebetween and a leather thumb portion. Disposed along the palm portion is a leather sheath housing an elongated raised rubber pad having lower and upper surfaces bounding a concave outer surface therebetween configured to cradle a bat handle. The pad preferably has a hardness greater than that of cellular polystyrene, more commonly known as Styrofoam®. When the glove is worn by the batter, the raised pad outer surface is configured to be substantially aligned with the distal ends of the metacarpals of the gloved hand.

18 Claims, 2 Drawing Sheets

BATTING GLOVE

FIELD OF THE INVENTION

The present invention relates generally to sporting equipment and more particularly to an improved baseball or softball batting glove.

BACKGROUND OF THE INVENTION

In baseball and softball batting, the grip of the bat employed by the batter's driving hand, which is the hand placed atop the other when gripping the bat, is critical to the successful outcome of a particular at-bat. Baseball and softball batters are often instructed to grip the bat with the driving hand near the fingertips in order to better control the plane and timing of the bat swing, thereby enhancing the ability to make consistent contact and place the batted ball where desired. This is generally a difficult instruction for batters to follow because batters tend to be most comfortable allowing the bat to rest deep in the cradle between the thumb and index finger, a grip commonly known as "throttling," giving a false feeling of improved bat control and greater hitting power.

Additionally, when the bat is throttled and the ball is struck by the end of the bat or by the portion of the bat near the hands, a strong shock is received by the batter's hand. This shock often bruises the bones of the thumb and index finger and the soft cradle of tissue lying between the thumb and index finger. Once a batter's hand sustains such a bruise, the hand becomes more sensitive to further shocks such that the batter may become less aggressive and, accordingly, less effective at the plate.

Accordingly, there exists a need in the art for an apparatus that encourages a properly oriented bat handle grip that promotes increased hitting production through sound technique and reduced injury risk. Additionally, it is desirable that the apparatus teach and/or condition the batter through repetitive use of the apparatus to properly grip the bat, thereby enabling a consistently employed proper grip with or without subsequent utilization of the apparatus.

SUMMARY OF THE INVENTION

According to the principles of the present invention, a batting glove that encourages a proper bat grip while reducing the injury risk to the batter's hands is disclosed.

In the preferred embodiment of the invention, a batting glove is provided incorporating a leather or fabric palm portion, a leather or fabric wrist portion including a hook and loop fastener, a leather finger portion including separate finger members having spaces therebetween and a leather thumb portion. Disposed along the palm portion is a leather sheath housing an elongated raised rubber pad having lower and upper surfaces bounding a concave outer surface therebetween configured to cradle a bat handle. The pad preferably has a hardness greater than that of cellular polystyrene, more commonly known as Styrofoam®. When the glove is worn by the batter, the raised pad outer surface is configured to be substantially aligned with the distal ends of the metacarpals of the gloved hand.

BRIEF DESCRIPTION OF THE DRAWING

The invention will be better understood from a reading of the following detailed description taken in conjunction with the drawing figures in which like reference designators are used to designate like elements, and in which.

DETAILED DESCRIPTION

Figure 1:
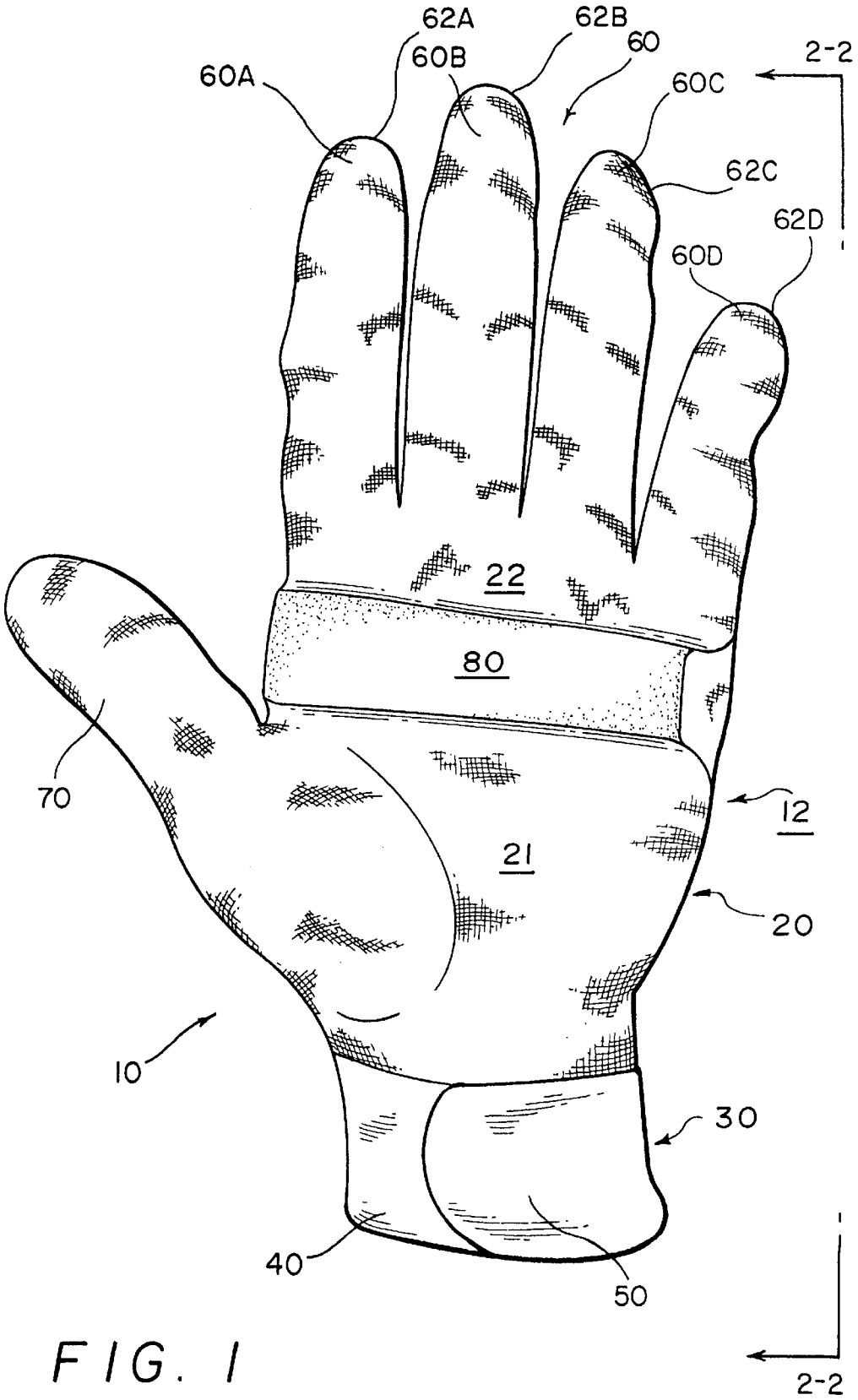
FIG. 1 is a plan view of the batting glove of the present invention.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

Figures 2, 3:
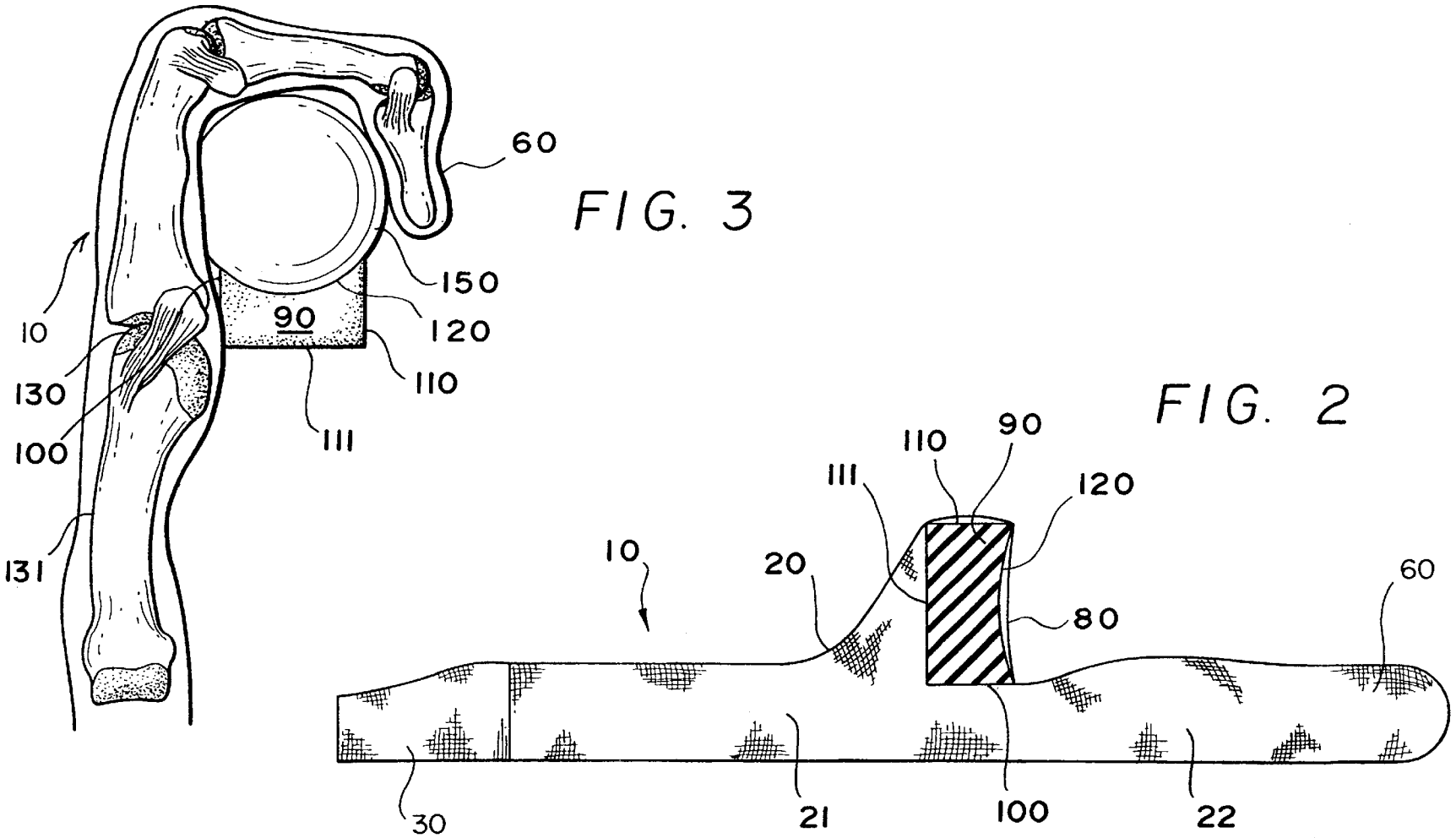
FIG. 2 is a transverse sectional view taken along line 2—2 in FIG. 1.
FIG. 3 is a perspective view showing the batting glove of the present invention on a wearer's hand and in gripping relation with a bat handle.

FIGS. 1 and 2 show the batting glove 10 of the present invention when not worn by a batter. The batting glove 10 comprises a glove body 12 made of leather, fabric or other suitable flexible material comprising a palm portion 20 having an inner section 21 and an outer section 22 serving to inhibit the formation of blisters on the wearer's palm. A wrist portion 30 having a main body 40 and a strap 50 is incorporated in order to secure the glove 10 to the wearer's hand. Preferably, main body 40 and strap 50 include cooperating hook and loop fasteners (not shown), although several different fastening elements known in the art may be substituted therefor. Finger portion 60 having separate finger members 60A, 60B, 60C and 60D is included. Finger members 60A, 60B, 60C and 60D are separated from each other extending from the fingertip portions 62A, 62B, 62C and 62D to outer section 22. Alternatively, the finger members 60A, 60B, 60C and 60D terminate at a unitary mitten. Finger members 60A, 60B, 60C and 60D inhibit the formation of blisters on the wearer's fingers. Thumb portion 70 is included to inhibit the formation of blisters on the wearer's thumb region.

Disposed between outer section 22 and inner section 21 is a sheath 80 housing an elongated raised pad 90. Pad 90 comprises a lower surface 100 and an upper surface 110. Disposed between lower surface 100 and upper surface 110 are an inner surface 111 and a concave outer surface 120. Outer surface 120 is preferably of a radius of curvature substantially equal to the radius of a regulation bat handle (i.e., between 1.875 and 4.374 inches) in order to cradle a bat handle 150. As shown in FIG. 3, when the glove 10 is worn by the batter, the most proximal point of outer surface 120 is substantially aligned with or up to ⅛" distal of the distal ends 130 of the metacarpals 131 of the batter's hand. By cradling the bat handle 150, pad outer surface 120 biases the bat handle 150 toward the batter's fingertips thereby promoting improved bat control and reduced injury risk to the thumb and immediately surrounding regions. Preferably, pad 90 is composed of rubber having a hardness greater than that of cellular polystyrene, more commonly known as Styrofoam®.

Although the invention has been described in terms of the illustrative embodiment, it will be appreciated by those skilled in the art that various changes and modifications may be made to the illustrative embodiment without departing from the spirit or scope of the invention. It is intended that the scope of the invention not be limited in any way to the illustrative embodiment shown and described but that the invention be limited only by the claims appended hereto.

What is claimed is:

1. A batting glove comprising a glove body having palm, wrist and finger portions to be worn on a batter's hand, the hand having metacarpals, the metacarpals having distal ends, said glove comprising:

an elongated raised pad having a lower surface facing toward the palm portion and an upper surface facing away from the palm portion, an inner surface facing toward the wrist portion and a concave outer surface between said upper and lower surfaces, said concave outer surface facing toward the finger portion said raised pad outer surface configured to be substantially aligned with the distal ends when said glove is worn.

2. A batting glove in accordance with claim 1, wherein:

said palm portion further comprises an inner section and an outer section, said palm portion inner section adjacent said raised pad inner surface, said palm portion outer section adjacent said raised pad outer surface.

3. A batting glove in accordance with claim 1, wherein:

said finger portion comprises separate finger members having spaces therebetween.

4. A batting glove in accordance with claim 3, wherein:

said finger portion comprises fingertip portions, said finger members being separated from each other extending from said fingertip portions to said palm portion outer section.

5. A batting glove in accordance with claim 2, comprising:

a thumb portion on one side of said palm portion inner section.

6. A batting glove in accordance with claim 1, wherein:

said pad comprises rubber having a hardness greater than that of cellular polystyrene.

7. A batting glove in accordance with claim 1, wherein:

said raised pad outer surface has a radius of curvature substantially equal to the radius of a regulation bat handle.

8. A batting glove in accordance with claim 1, comprising:

a sheath enveloping said pad.

9. A batting glove to be worn on a batter's driving hand, the hand having metacarpals, the metacarpals having distal ends, said glove comprising:

an elongated raised rubber pad having a lower surface and an upper surface and an inner surface and concave outer surface between said upper and lower surfaces, said raised pad outer surface configured to be substantially aligned with the distal ends when said glove is worn, said pad having a hardness greater than that of cellular polystyrene, said raised pad outer surface having a radius of curvature substantially equal to the radius of a regulation bat handle;

a leather palm portion having an inner section and an outer section, said palm portion inner section adjacent said raised pad inner surface, said palm portion outer section adjacent said raised pad outer surface;

a leather sheath enveloping said pad;

a leather wrist portion adjacent said palm portion inner section opposite said raised pad inner surface, said wrist portion including a hook and loop fastener;

a leather finger portion adjacent said palm portion outer section opposite said raised pad outer surface, said finger portion including separate finger members having spaces therebetween, said finger portion including fingertip portions, said finger members being separated from each other extending from said fingertip portions to said palm portion outer section; and a leather thumb portion on one side of said palm portion inner section.

10. A method of gripping a baseball bat or the like with a driving hand whereby the bat handle is forced away from the thumb base of the hand and into the region adjacent the metacarpal interphalangeal joints of the hand, the method comprising the steps of:

forming a batting glove comprising an elongated raised pad having a lower surface and an upper surface and an inner surface and concave outer surface between said upper and lower surfaces;

inserting the driving hand into said batting glove such that said raised pad outer surface is substantially aligned with the distal ends of the metacarpals of the hand; and gripping the bat handle such that the handle is engaged by said raised pad outer surface.

11. A method in accordance with claim 10, comprising the step of:

forming a palm portion having an inner section and an outer section, said palm portion inner section adjacent said raised pad inner surface, said palm portion outer section adjacent said raised pad outer surface.

12. A method in accordance with claim 11, comprising the step of:

forming a wrist portion adjacent said palm portion inner section opposite said raised pad inner surface.

13. A method in accordance with claim 11, comprising the step of:

forming a finger portion adjacent said palm portion outer section opposite said raised pad outer surface.

14. A method in accordance with claim 13, wherein:

said finger portion comprises separate finger members having spaces therebetween.

15. A method in accordance with claim 11, comprising the step of:

forming a thumb portion on one side of said palm portion inner section.

16. A method in accordance with claim 10, wherein:

said pad comprises rubber having a hardness greater than that of cellular polystyrene.

17. A method in accordance with claim 10, comprising the step of:

forming a sheath enveloping said pad.

18. A method of gripping a baseball bat or the like with a driving hand whereby the bat handle is forced away from the thumb base of the hand and into the region adjacent the metacarpal interphalangeal joints of the hand, the method comprising the steps of:

forming a batting glove comprising an elongated raised rubber pad having a lower surface and an upper surface and an inner surface and concave outer surface between said upper and lower surfaces, said pad having a hardness greater than that of cellular polystyrene;

forming a leather palm portion having an inner section and an outer section, said palm portion inner section adjacent said raised pad inner surface, said palm portion outer section adjacent said raised pad outer surface;

forming a leather sheath enveloping said pad;

forming a leather wrist portion adjacent said palm portion inner section opposite said raised pad inner surface, said wrist portion including a hook and loop fastener;

forming a leather finger portion adjacent said palm portion outer section opposite said raised pad outer surface, said finger portion including separate finger members having spaces therebetween;

forming a leather thumb portion on one side of said palm portion inner section;

inserting the driving hand into said batting glove such that said raised pad outer surface is substantially aligned with the distal ends of the metacarpals of the hand; and gripping the bat handle such that the handle is engaged by said raised pad outer surface.

* * * * *